US005255474A

United States Patent [19]

Gawa et al.

[11] Patent Number: 5,255,474

[45] Date of Patent: Oct. 26, 1993

[54] POLISHING SPINDLE

[75] Inventors: Tomohiro Gawa, Hirakata; Katsuyoshi Shingu, Moriguchi; Kiyoshi Mayahara, Hirakata, all of Japan

[73] Assignee: Matsushita Electric Industrial Co., Ltd., Osaka, Japan

[21] Appl. No.: 31,927

[22] Filed: Mar. 16, 1993

Related U.S. Application Data

[63] Continuation of Ser. No. 740,614, Aug. 5, 1991, abandoned.

[30] Foreign Application Priority Data

Aug. 6, 1990 [JP] Japan ..... 2-208600

[51] Int. Cl.[5] ..... B24B 5/16; B24B 29/02

[52] U.S. Cl. ..... 51/131.1; 51/109 R; 51/373; 51/284 R

[58] Field of Search ..... 51/109 R, 125, 284 R, 51/165.77, 165.9, 129, 131.1, 131.4, 124 L, 373

[56] References Cited

U.S. PATENT DOCUMENTS

| | | | |
|---|---|---|---|
| 1,966,521 | 7/1934 | Ricks | 51/373 |
| 3,035,377 | 5/1962 | Bovensiepen et al. | 51/109 |
| 4,216,626 | 8/1980 | Starp | 51/124 L |
| 4,598,502 | 7/1986 | Lombard | 51/124 L |
| 4,665,658 | 5/1987 | Carcey | 51/120 |
| 4,999,954 | 3/1991 | Miyamoto et al. | 51/124 L |

*Primary Examiner*—Bruce M. Kisliuk
*Assistant Examiner*—Bo Bounkong
*Attorney, Agent, or Firm*—Wenderoth, Lind & Ponack

[57] ABSTRACT

A polishing spindle is provided for use in a polishing device which includes a hollow spline shaft, and a polishing tool having a polishing member which defines a first bag-like elastic member and is attached in an air-tight manner to a forward end of the hollow spline shaft. A device supplies a compressive fluid to the other end of the hollow spline shaft through a rotary joint, another device rotatably supports a nut which engages the hollow spline shaft, and a further device rotates the hollow spline shaft. A still further device is provided for displacing the hollow spline shaft in an axial direction. A second elastic member is provided along the axial direction of the hollow spline shaft so as to depress the polishing member against a workpiece under a constant pressure.

7 Claims, 2 Drawing Sheets

POLISHING SPINDLE

This application is a continuation of now abandoned application Ser. No. 07/740,614, filed Aug. 5, 1991.

BACKGROUND OF THE INVENTION

The present invention generally relates to a polishing device and more particularly, to a polishing spindle for use in a polishing device to be employed in a polishing/-finishing process, i.e. a so-called polishing process for all kinds of lenses such as spherical lenses, aspherical lenses, etc.

Conventionally, there have been employed various kinds of polishing processes for spherical and aspherical lenses.

Particularly, in the field of optical instruments, it has been a trend in recent years that not only the spherical, but also aspherical optical glass lenses of required configurations are being used to reduce the size and weight and increase the performance of optical instruments. For example, in a toric lens to be used in a laser beam printer, a special shape is required, and the desired shape has been obtained by subjecting a workpiece which had been previously ground to a spherical shape having an approximate radius of curvature to a finish polishing process, by changing tools during processing. By way of example, for the above practice, there has been employed a known arrangement as shown in FIGS. 3(*a*) and 3(*b*) and disclosed in Japanese Patent Laid-Open Publication Tokkaisho No. 63-216664.

Hereinbelow, the above conventional polishing device will be explained with reference to a side sectional view shown in FIG. 3(*a*) and a front elevational view shown in FIG. 3(*b*) of the polishing device.

The known polishing device of FIGS. 3(*a*) and 3(*b*) is so arranged that, by attaching a workpiece 1 onto an outer periphery of a rotatable wheel 2, a female die jig 3 of iron, cast iron, stainless steel or the like formed with a concave toric surface is urged against an outer peripheral processing surface of the workpiece 1 under a predetermined force F. In the above state, an abrasive material, such as abrasive grain of green silicon carbide of #600 to #4000 and the like, is supplied between the female die jig 3 and the processing surface of the workpiece 1 while the wheel 2 is being rotated. Further, the female die jig 3 is oscillated in a direction intersecting at right angles with a rotating direction of said wheel 2. In this manner, lapping processing can be effected by successively reducing the particle size of the abrasive grain. In a finishing step, a polisher of polyurethane or the like is applied onto the female die jig 3, while grain particles of selium oxide having particle size of about 1 μm are fed between the jig 3 and the processing surface for polishing in a similar manner as above. The female die jig 3 having a proper length along the workpiece 1 in the rotating direction of the wheel 2 is engaged, at opposite ends of its upper surface, with tips of a pair of depressing needles 4 so as to be supported for oscillation in a transverse direction, while also being pivotable in the longitudinal direction, since the depressing needles 4 are fixed at opposite ends of a pivot lever 5 supported for pivotal movement in a longitudinal direction of the female die jig 3. Meanwhile, the pivot lever 5 is pivotally connected to an operating arm 6 urged towards the axis of the wheel 2 and reciprocably movable in the axial direction of the wheel 2.

However, in the conventional arrangement for lapping and polishing as described above, since the direction of oscillation of the female die jig 3 is naturally the same at any position along the longitudinal direction, even if the oscillating face S is aligned with the radial direction T of the wheel 2 at the central portion, such oscillating face S will be inclined by an angle Θ with respect to the radial direction T of the wheel 2 at the opposite ends (FIG. 3(*b*)). Therefore, the curvature of the curved surface to be formed by the oscillation of the female die jig 3 is not in agreement with the toric face in terms of principle. Accordingly, in actual use of such processing method, it is very difficult to attain high accuracy of the toric surface. It is also difficult to maintain the accuracy of the toric surface for the female die jig 3, and thus, skill and "knack" are required as in manual processing to obtain high accuracy, thus resulting in very poor productivity and consequent high costs.

In order to overcome the disadvantages as described above, Japanese Patent Laid-Open Application Tokkaisho No. 63-216664 (referred to earlier) intends to solve the problem by an arrangement in which a processing point of a processing tool effects a drum-shaped locus movement with a radius of curvature equal to the radius of curvature at one side of the toric surface to be processed, to thereby achieve higher accuracy and efficiency in processing. However, in such known arrangement, the apparatus main body is complicated and requires high accuracy, and even if the arrangement is suitable as a grinding apparatus, it is not suitable as a polishing apparatus.

Meanwhile, although there has further been proposed a polishing method by an elastic member having an inner pressure, the amount of deformation of the elastic member is limited only by the control of the inner pressure, and thus, the contact area with the workpiece is undesirably varied. This results in a non-uniform depressing force per unit area, and makes it impossible to quantitatively determine the amount of processing necessary to obtain a polished surface at high accuracy.

SUMMARY OF THE INVENTION

Accordingly, an essential object of the present invention is to provide a polishing spindle which can be used for polishing processing of spherical and aspherical surfaces in general, as well as toric surfaces of optical lenses, in an efficient manner.

Another object of the present invention is to provide a polishing spindle of the above described type which is simple in construction and high accurate in functioning.

In accomplishing these and other objects, according to one preferred embodiment of the present invention, there is provided a polishing spindle which includes a hollow spline shaft, a polishing tool having a polishing member (which defines a first elastic member having a bag-like shape and will be hereinafter referred to merely as an elastic polishing member), attached in an airtight manner to a forward end of the hollow spline shaft, means for supplying a compressive fluid to the other end of the hollow spline shaft through a rotary joint, means for rotatably supporting a nut which engages the hollow spline shaft, means for rotating the hollow spline shaft, means for displacing the hollow spline shaft along an axial direction, and a second elastic member provided in an axial direction of the hollow spline shaft for depressing the polishing member against a workpiece under a constant pressure.

In a modification of the present invention, the polishing spindle as described above further includes a pressure detector for detecting pressure reduction of the compressive fluid due to breakage of the elastic polishing member.

In the first embodiment of the present invention as described earlier, the polishing member which defines the first elastic member having the bag-like shape expands due to an increase in the internal pressure caused by the compressive fluid, to thereby depress the surface of the workpiece preliminarily subjected to grinding processing. Since it is difficult to quantitatively control the amount of deformation and the depressing force of the elastic polishing member by merely controlling the internal pressure of the elastic polishing member, it is so arranged that the second elastic member depresses the first elastic polishing member onto the workpiece together with the hollow spline shaft. Thus, the contact area with respect to the workpiece is maintained constant, and simultaneously, the depressing force generated at the processing point may also be kept constant. Accordingly, the preliminarily ground workpiece can be subjected to the polishing finish to provide a surface roughness of Rmax=0.5 to 0.01 μm or thereabout. By employing this polishing spindle, the polishing device is simplified in construction with its accuracy being allowed up to about 0.1 mm. Thus, a polishing device which is readily adjustable along its axis and is capable of effecting polishing processing at high accuracy can be provided.

In the modification of the present invention, in preparation for troubles such as breakage due to abrasion of the first elastic polishing member, when the internal pressure of the elastic polishing member is lowered due to leakage of the compression air, etc., the lowering of pressure is detected by the pressure detector, and, by producing abnormal signals. Thus, a warning may be emitted or the apparatus can be stopped, so as to immediately cope with the trouble.

BRIEF DESCRIPTION OF THE DRAWINGS

These and other objects and features of the present invention will become apparent from the following description taken in conjunction with the preferred embodiment thereof with reference to the accompanying drawings, in which:

FIG. 3(*b*) is a front elevational view of the polishing device of FIG. 3(*a*).

DETAILED DESCRIPTION OF THE INVENTION

Figure 1:
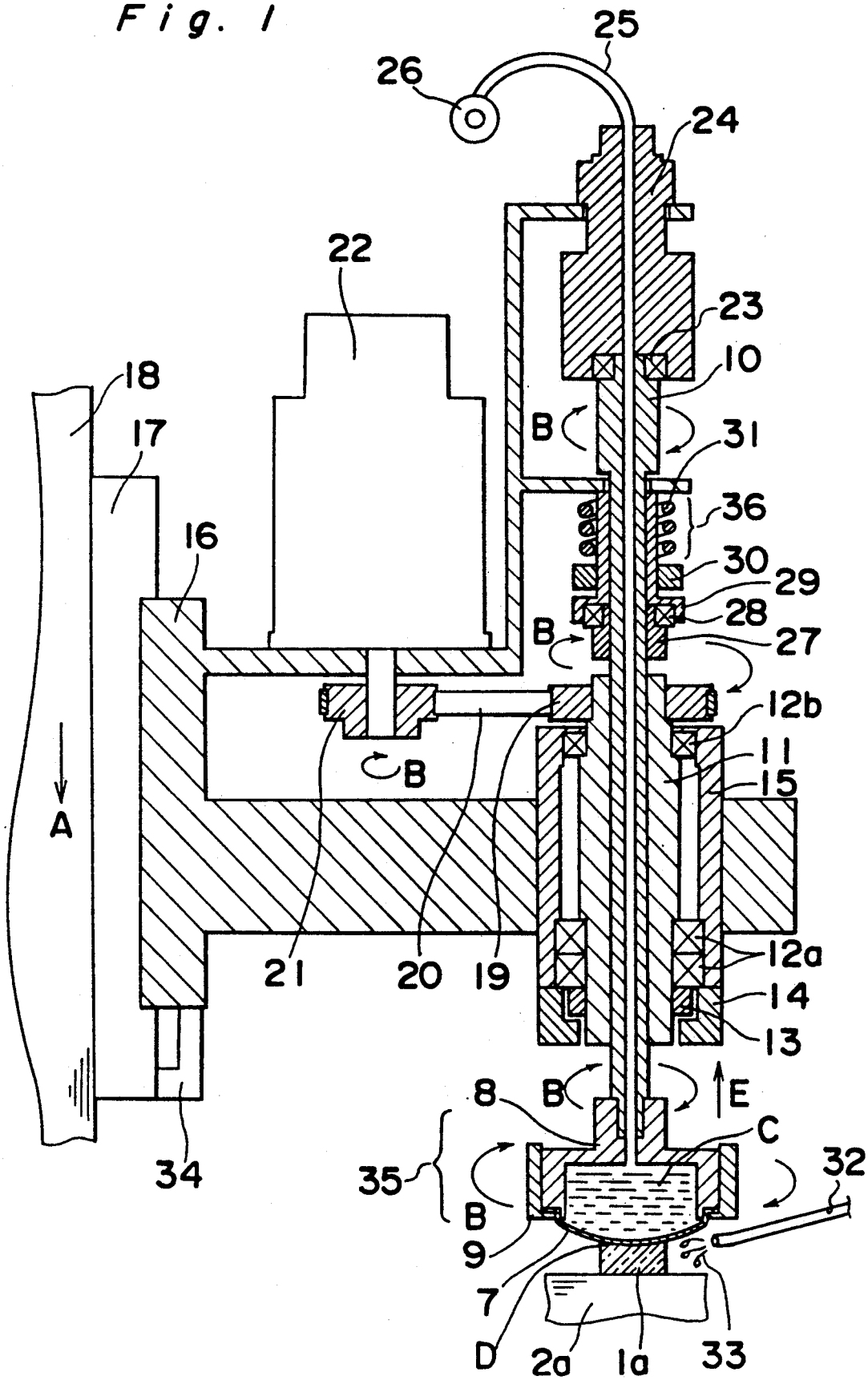
FIG. 1 is a vertical sectional view of a polishing spindle according to one preferred embodiment of the present invention.

Before the description of the present invention proceeds, it is to be noted that like parts are designated by like reference numerals throughout the accompanying drawings.

Referring now to the drawings, there is shown in FIG. 1, a polishing spindle according to one preferred embodiment of the present invention, which includes a hollow spline shaft 10, a polishing tool 35, having a polishing member 7 which defines a first elastic member which is on elastic polishing sheet having a bag-like shape, attached in an airtight manner to a forward end (i.e. a lower end in FIG. 1) of the hollow spline shaft 10, means for supplying a compressive fluid C to the other end of the hollow spline shaft 10 through a rotary joint 24, means for rotatably supporting a nut 11 which engages the hollow spline shaft 10, means for rotating the hollow spline shaft 10, means for displacing the hollow spline shaft 10 in an axial direction (i.e. along its rotary axis), and a second elastic member 31 provided along the rotary axis direction of the hollow spline shaft 10 so as to depress the polishing member 7 onto a workpiece 1*a* or an article to be processed under a constant pressure.

More specifically, as shown in FIG. 1, the workpiece 1*a* is held by a rotatable wheel 2*a* (partially shown). The polishing member 7 which is the first elastic member having the bag-like shape constitutes the polishing tool 35 together with cases 8 and 9 in which the compressive fluid C is sealed. This polishing tool 35 is mounted to the forward end (lower end in FIG. 1) of the hollow spline shaft 10, while the rotary joint 24 is provided at the other end (upper end in FIG. 1) of the hollow spline shaft 10 through a bearing 23 so as to be connected to a compressive fluid source 26 via a pipe line 25. Meanwhile, the hollow spline shaft 10 is capable of transmitting rotary motion as one unit with the nut 11 at the bearing portion, and is also capable of sliding movement in the axial direction as indicated by an arrow E. This nut 11 is rotatably supported by a spindle case 15 through bearings 12*a* and 12*b*, and the bearing 12*a* can produce axial pressurization by a bearing inner ring presser 13 and a bearing outer ring presser 14. Meanwhile, the nut 11 is associated with a rotary driving unit 22 through pulleys 19 and 21 and a belt 20. The spindle case 15 and the rotary driving unit 22 are secured to a slide base 16 which slides along a rail 17 fixed to a polishing device main body 18 so as to allow contact or spacing between the workpiece 1*a* and the polishing tool 35. A stopper 34 provided at a lower portion of the rail 17 serves for positioning of the slide base 16, and also, determines the state of contact between the polishing tool 35 and the workpiece 1*a*.

Moreover, in a position above the pulley 19, a ring 27 is fixed onto the hollow spline shaft 10, while a thrust bearing 28 is held between the ring 27 and a bushing 29, and a stopper ring 30 attached to the bushing 29 is disposed so as to enable adjustment of the depressing force of a coil spring 31 which defines the second elastic member. In the actual processing, a polishing liquid 33 is fed to a contact point D between the workpiece 1*a* and the elastic polishing member 7 by a nozzle 32, etc.

Subsequently, functioning of the polishing spindle having the construction described above will be explained.

In the first place, by an, elevating means (not shown) provided on the polishing device main body 18 for moving the slide base 16 toward or away from the workpiece 1*a*, the polishing spindle main body is lowered in a direction indicated by an arrow A, down to a position set by the stopper 34. The polishing tool 35 is supplied with the compressive fluid C from the compressive fluid source 26, whereby the internal pressure of the elastic polishing member 7 is raised to a higher pressure resulting in uniform expansion of the polishing member 7 so as to contact the surface of the workpiece 1*a* to be processed. The polishing tool 35 is attached to the hollow spline shaft 10, while the hollow spline shaft 10 receives the rotational driving force in a direction represented by arrows B transmitted from the rotary driving unit 22 through the pulleys 19 and 21 and the belt 20, and is rotated at a speed of about 10 to 2000 r.p.m. Accordingly, the polishing tool 35 is also rotatable in the direction represented by the arrows B. Although the other end of the hollow spline shaft 10 is connected to the compressive fluid source 26 by the pipe line 25, since the rotary joint 24 is present between the hollow spline shaft 10 and the pipe line 25, with the rotary joint 24 being rotatably supported by the slide base 16, the pipe line 25 is not subjected to any twisting or torsion. In this case, since the nut 11 is rotatably held by the spindle case 15 fixed to the slide base 16, through the bearing 12*a* and 12*b*, the hollow spline shaft 10 engaged with the nut 11 may be rotated.

On the other hand, the bushing 29 is fitted over the ring 27 fixed to the hollow spline shaft 10 so as to hold the thrust bearing 28 therebetween, and the compressed length of the spring 31, which is the second elastic member, is adjusted by the stopper ring 30 provided on the outer periphery of the bushing 29, whereby a compression force is produced at the spring compressing portion 36. The compression force thus generated between the slide base 16 and the stopper ring 30 is transmitted to the elastic polishing member 7 of the polishing tool 35 through the bushing 29, the thrust bearing 28, the ring 27 and the hollow spline shaft 10, and thus, the depressing force can be applied to the workpiece 1*a*.

With just the provision of the elastic polishing member 7, the contact area is varied particularly for the aspherical lenses, etc. having uneven distances with respect to the workpiece 1*a* even when only the internal pressure is made uniform, with consequent instability in the facial pressure. However, with the further provision of the second elastic member according to the present invention, it becomes possible to keep constant the depressing area of the polishing member with respect to the workpiece. Therefore, stability and uniformity in the processing amount may be positively enhanced, while the range of the depressing force is expanded to facilitate control such that it will be possible to quantitatively determine the amount of processing necessary.

Figure 2:
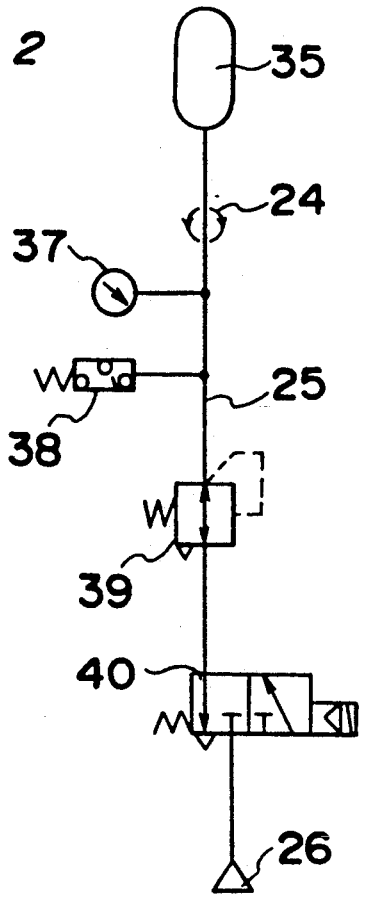
FIG. 2 is a piping circuit diagram of compressive fluid for a polishing spindle in a modification of the present invention.
Figure 3A:
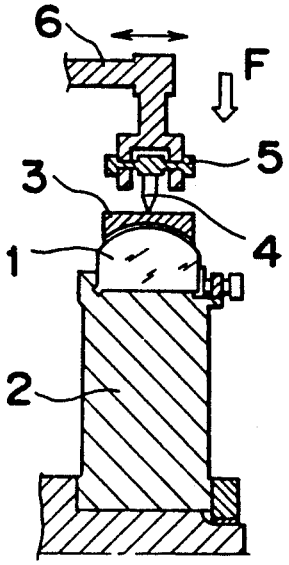
Fig. 3(a) PRIOR ART
FIG. 3(*a*) is a side sectional view of a conventional polishing device.
Figure 3B:
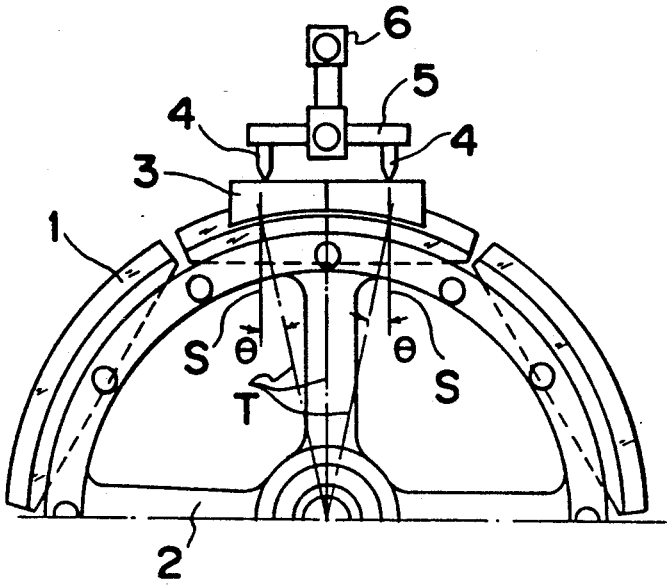
Fig. 3(b) PRIOR ART

Reference is made to a piping circuit diagram of FIG. 2 schematically showing a modification of the polishing spindle of FIG. 1 as described above.

In the modified polishing spindle of FIG. 2, along the pipe line 25 between the rotary joint 24 and the compressive fluid source 26 in an arrangement similar to that shown in FIG. 1, there are further provided a pressure gauge 37, a pressure detector 38, a pressure reducing valve 39, and another valve 40, etc. so that if damage to the elastic polishing member 7, such as breakage of the polishing tool 35 due to abrasion or foreign matter, should take place and cause lowering of the internal pressure, such pressure reduction can be detected by the pressure detector 38.

With the above arrangement in the modified polishing spindle of FIG. 2, it becomes possible to immediately cope with such trouble, for example, by warning of abnormal functioning of the polishing spindle or stopping of the polishing device, etc. Thus, not only can adverse effects to the workpiece 1*a* be avoided, but efficiency of the installation in a production line on the whole can be improved.

As is clear from the foregoing description, according to the polishing spindle of the present invention, polishing processing of glass lenses having aspherical surfaces as well as spherical surfaces, can be readily effected with high accuracy, while cost reduction and compact size of the polishing device can be achieved for consequent reduction of the price of the final products.

Furthermore, if the modified polishing spindle of the present invention provided with the pressure detector for detecting the lowering in pressure of the compressive fluid due to breakage of the polishing member is employed as described with reference to FIG. 2, remarkably higher performance of the polishing device can be achieved, and working efficiency can be improved.

Although the present invention has been fully described by way of example with reference to the accompanying drawings, it is to be noted here that various changes and modifications will be apparent to those skilled in the art. Therefore, unless such changes and modifications otherwise depart from the scope of the present invention, they should be construed as included therein.

What is claimed is:

1. A polishing apparatus comprising:
a base;
a nut rotatably mounted to said base;
an elongated shaft having a forward end and a rearward end, extending through said nut, and being fixed for rotation with said nut;
a rotary drive unit operably connected to said nut to rotate said nut relative to said base;
a polishing tool fixedly secured to said forward end of said shaft, said polishing tool comprising a casing having a chamber defined therein adapted to receive pressurized fluid, and a flexible elastic polishing sheet fixedly secured to said casing to close a forward end of said chamber;
biasing means for biasing said shaft forwardly relative to said base in order to press said elastic polishing sheet against a workpiece under a constant pressure; and
pressurized fluid supply means for supplying pressurized fluid to said chamber to cause expansion of said flexible elastic polishing sheet while allowing inward flexion of portions of said polishing sheet to accommodate an aspheric shape of the workpiece.

2. A polishing apparatus as recited in claim 1, wherein said pressurized fluid supply means includes a bore formed axially through said elongated shaft and opening into said chamber.

3. A polishing apparatus as recited in claim 2, wherein said pressurized fluid supply means further includes a fluid source, and a fluid line connecting said fluid source to said bore; and
a rotary joint is provided to allow rotation of said elongated shaft relative to said fluid line.

4. A polishing apparatus as recited in claim 1, wherein said elongated shaft comprises a spline shaft.

5. A polishing apparatus as recited in claim 1, further comprising
a main body; and
means for axially displacing said elongated shaft relative to said main body.

6. A polishing apparatus as recited in claim 1, further comprising
pressure detecting means for detecting a reduction in pressure of the pressurized fluid fed to said chamber of said polishing tool.

7. A polishing apparatus as recited in claim 1, wherein said polishing tool is secured to said elongated shaft in an airtight manner.

* * * * *